US006112460A

United States Patent [19]

Wagnitz

[11] Patent Number: 6,112,460

[45] **Date of Patent: *Sep. 5, 2000**

[54] WALK-THROUGH GATE WITH TOP RAIL SUPPORT

[75] Inventor: Kurt P. Wagnitz, Green Bay, Wis.

[73] Assignee: Evenflo Company, Inc., Vandalia, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/177,397

[22] Filed: Oct. 23, 1998

[51] Int. Cl.[7] ..... E06B 3/68; E06B 7/00; E06B 9/01

[52] U.S. Cl. ..... 49/55; 49/394; 49/465

[58] Field of Search ..... 49/55, 50, 57, 49/465, 463, 394, 472, 381, 458, 413, 445; 160/222, 225

[56] References Cited

U.S. PATENT DOCUMENTS

| | | |
|---|---|---|
| 128,582 | 7/1872 | Boughton . |
| 151,599 | 6/1874 | Kells . |
| 193,573 | 7/1877 | Tripp . |
| 260,679 | 7/1882 | Harley . |
| 280,614 | 7/1883 | Harley . |
| 281,964 | 7/1883 | Brent . |
| 295,163 | 3/1884 | Grove . |
| 311,044 | 1/1885 | Tarney . |
| D. 341,207 | 11/1993 | Freese et al. . |
| 351,502 | 10/1886 | Dougherty . |
| 376,436 | 1/1888 | Harrison . |
| 457,639 | 8/1891 | Doenitz . |
| 470,350 | 3/1892 | Nunn . |
| 471,467 | 3/1892 | Crisson . |
| 546,909 | 9/1895 | Spencer . |
| 646,120 | 3/1900 | Gallaher . |
| 700,362 | 5/1902 | Niehaus . |
| 746,403 | 12/1903 | Tarney . |
| 832,335 | 10/1906 | McDonald . |
| 855,769 | 6/1907 | Grant . |
| 975,470 | 11/1910 | Shrady . |
| 1,175,109 | 3/1916 | Anderson . |
| 1,295,712 | 2/1919 | Drew . |
| 1,325,519 | 12/1919 | Jenkins . |

(List continued on next page.)

FOREIGN PATENT DOCUMENTS

| | | |
|---|---|---|
| 23 57 660 A1 | 11/1973 | Germany . |
| 651926 | 4/1951 | United Kingdom . |
| 2 058 186 | 4/1981 | United Kingdom . |
| 2 214 551 | 9/1989 | United Kingdom . |
| 2 234 283 | 1/1991 | United Kingdom . |
| WO 93/07352 | 4/1993 | WIPO . |
| WO 94/00664 | 1/1994 | WIPO . |

*Primary Examiner*—Daniel P. Stodola
*Assistant Examiner*—Hugh B. Thompson
*Attorney, Agent, or Firm*—Robert G. Crouch; F. A. Sirr; Holland & Hart LLP

[57] ABSTRACT

A horizontally extendable, two section gate assembly for use in restricting access through a wide opening that is defined by a pair of horizontally spaced and vertically extending walls. One end of the gate mounts hinges that are removably received within hinge brackets mounted on one wall. A swing stop allows the gate to swing in only one direction. The other end of the gate mounts a manual latch mating with a latch bracket mounted on the other wall. Two gate sections each include a horizontal upper support bar. Each upper support bar includes a horizontally extending open face slot that mates with the open face slot in the other support bar. Opposite ends of the two slots include a fixed position and extending slide block. Each slide block is fixed within one slot and is movable in the other slot, to provide low friction relative movement of the two gate sections, and to support the two gate sections in an extended position so that no gate sag is experienced. Opening the two gate sections to the fully extended position is limited by the position of two of a number of U-shaped metal brackets that hold the two gate sections together. Alternatively, the slide blocks are positioned to limit extension of the two gate sections.

17 Claims, 4 Drawing Sheets

U.S. PATENT DOCUMENTS 1,393,405 10/1921 Soteros et al. .
1,438,202 12/1922 Wieland .
1,450,920 4/1923 Hutchinson .
1,469,525 10/1923 Nadolney .
1,497,849 6/1924 Hart .
1,519,908 12/1924 Etue .
1,525,926 2/1925 Eutin .
1,532,769 4/1925 McElroy .
1,608,667 11/1926 Poetsch .
1,662,586 3/1928 Newman .
1,756,030 4/1930 Kownatzky ..... 49/55
1,908,989 5/1933 Lahey et al. .
1,958,695 5/1934 Claus .
1,964,332 6/1934 Rembaum .
2,099,068 11/1937 Keithly .
2,225,963 12/1940 Augustine .
2,357,819 9/1944 Greer .
2,624,402 1/1953 Lukasavicz .
2,793,050 5/1957 Cook .
2,851,746 9/1958 McPhaden ..... 20/71
3,000,063 9/1961 Hoog .
3,346,289 10/1967 Anderson ..... 292/175
3,454,075 7/1969 Weinstein .
3,583,466 6/1971 Dreyer .
3,636,683 1/1972 Francis et al. ..... 55/493
3,774,958 11/1973 Thorpe .
3,800,714 4/1974 Stark et al. ..... 105/377
3,812,616 5/1974 Koziol .
3,978,619 9/1976 Gregoire ..... 49/504
4,103,445 8/1978 Smith et al. .
4,124,322 11/1978 Parisien .
4,139,249 2/1979 Hillman ..... 312/333
4,300,316 11/1981 Ficurilli ..... 49/445
4,377,303 3/1983 McPherson ..... 292/152
4,431,331 2/1984 Brody .
4,482,023 11/1984 Dziedzic et al. ..... 180/89.17
4,492,263 1/1985 Gebhard .
4,583,715 4/1986 Wright .
4,607,455 8/1986 Bluem et al. ..... 49/55
4,611,431 9/1986 Lauro .
4,628,635 12/1986 Maillard .
4,677,791 7/1987 Larson et al. ..... 49/463
4,685,247 8/1987 Alam .
4,787,174 11/1988 Brown .
4,825,921 5/1989 Rigter .
4,831,777 5/1989 Johnson, Jr. .
4,846,246 7/1989 Stern .
4,884,614 12/1989 Spurling ..... 160/225
4,944,117 7/1990 Gebhard et al. .
5,018,302 5/1991 Kluge ..... 49/56
5,052,461 10/1991 Stern .
5,060,421 10/1991 Castelli .
5,113,611 5/1992 Rosson .
5,134,806 8/1992 Burkart, Jr. ..... 49/463
5,207,260 5/1993 Commesso .
5,217,265 6/1993 Lerner et al. ..... 292/200
5,272,840 12/1993 Knoedler et al. ..... 49/463
5,293,656 3/1994 Chan .
5,294,167 3/1994 Yu .
5,367,829 11/1994 Crossley et al. ..... 49/465
5,437,115 8/1995 Freese et al. ..... 49/465
5,442,881 8/1995 Asbach et al. ..... 49/465
5,505,244 4/1996 Thumann .
5,524,944 6/1996 Berg ..... 292/163
5,531,258 7/1996 Poulson et al. ..... 160/376
5,533,214 7/1996 Graham .
5,533,715 7/1996 Dandrea .
5,549,347 8/1996 Anderson .
5,636,679 6/1997 Miller et al. .
5,638,885 6/1997 Freese et al. .
5,690,317 11/1997 Sandsborg .

WALK-THROUGH GATE WITH TOP RAIL SUPPORT

U.S. patent application Ser. No. 08/735,972 by Scott Allen Slyvester and Clifford W. Russell, filed Oct. 25, 1996, now U.S. Pat. No. 6,016,629 and entitled WALK-THROUGH GATE, is incorporated herein by reference.

BACKGROUND OF THE INVENTION

1. Field of the Invention

This invention relates to walk-through gates, and more specifically, to walk-through gates having a plurality of gate sections that are horizontally extended to span openings of varying widths.

2. Description of the Related Art

It is well known to provide safety gates for doorways, stair wells or staircases in order to prevent the passage therethrough of small children, infants, or pets.

One common type of safety gate includes gate sections that can be expanded sufficiently to place friction pads into frictional engagement with the vertical surfaces or walls that define such an opening that is to be closed by the safety gate. Safety gates of this type have several disadvantages. First, the expanded gate sections may sometimes not be adjusted properly by the user, and thus may not provide a tight fit with the opening walls. In this case, the gate is not sturdily attached to the walls, and can be easily pushed over or otherwise defeated by a child or pet.

Also, many gates of this type do not work well when the two opposing walls are not truly vertical, a situation that is not uncommon. In this case, the upper or the lower portion of the gate may make better frictional contact with the walls than does the other gate portion, causing a situation in which the safety gate can be easily defeated.

Even if a safety gate of this type is properly adjusted to make very tight frictional contact with the two opposed walls, paint, wallpaper, or another finish on the two walls may be damaged by the friction pads. Lastly, it may be inconvenient to repeatedly disconnect and reconnect the compressed safety gate sections when passage through the gate is required.

Another class of safety gate typically includes the more permanent mounting of one side of the gate to one opposed wall, and some type of latching or locking of the other side of the gate to the opposite wall. Typically, the latch/lock may include a mechanism such as a hook and eye combination, or some other manually releasable mechanism. Gates of this type also have inherent drawbacks. First, the latch/lock mechanism are sometimes not adequately secure, and may sometimes be easily defeated by a child or pet. Second, these gates may not be easily removable from a doorway or staircase at those times during which it is not desirable to have the gate in place.

It is against this background, and with the desire to solve problems of the above type that are found in the prior art, that the present invention was developed.

SUMMARY OF THE INVENTION

This invention provides a walk-through gate assembly whose plural gate sections can be manually extended in the horizontal direction so as to span a wide opening, for example an opening in the range 42 to 65-inches. Most desirably, the present invention provides a new and an unusual construction and arrangement whereby such a wide opening gate assembly is not only easy to open or extend, but in addition, when extended, the walk-through gate assembly does not sag or droop downward. Preferred embodiments of the invention to be described relate to a pivoted and latched walk-through gate assembly, but the spirit and scope of the invention is not to be limited thereto.

In embodiments of the invention to be described, the gate assembly is generally rectangular in shape, having a fixed vertical dimension, for example 28.5 inches, and a variable horizontal dimension that varies generally from a fully collapsed dimension of about 39.0 inches, to a fully extended dimension of about 64.0 inches. In operation, the gate assembly is adapted to close wide stair wells, doorways or openings that are in the general range of from about 42-inches to about 65-inches wide.

In an embodiment of the invention, the gate assembly is formed by two similar dimension, rectangular, and planar shaped gate sections. These two gate sections are horizontally movable relative to one another, they are mounted closely adjacent to each other, and they generally overlap. The two gate sections overlap to a large extent when the gate is not extended, for example, when the gate is not in use, when it is boxed, when it is stored, and the like. The two gate sections overlap to a stop controlled minimum extent when the gate is extended to span a wide 65-inch opening.

In an embodiment of the invention, one end of one gate section is hinged to one side of the opening, and the other end of the other gate section is latched to the other side of the opening. The gate assembly may optionally include a swing stop that is associated with its hinged end. In operation, this swing stop operates to allow the gate assembly to swing or open in only one direction. In this way, the gate assembly may be prevented from opening or pivoting over a stairwell, into a high traffic are, and the.

Each of the two gate sections includes a linear, horizontally extending, and generally top disposed support bar. These two top support bars are retained or supported so that their two inside, mating, and adjacently facing surfaces are in low friction sliding contact. Preferably, these two adjacently facing surfaces are each provided with a low friction coating; for example, lacquered surfaces that are wax coated.

Each of these two inside facing surfaces includes a horizontally extending U-shaped groove, and these two facing grooves occupy a common horizontal plane. The opposite end portions of these facing U-shaped grooves each includes a low friction slide block, each block extending a short distance of each U-shaped groove. Each of the two slide blocks is mounted at a fixed position within one groove, and slidably extends into the other groove, to thereby form two low friction sliding supports for the two gate sections.

The construction and arrangement afforded by the above-described slide blocks not only facilitates an ease of gate extension, but additionally prevents the wide extended gate assembly from sagging downward as the gate assembly spans a wide opening.

Accordingly, it is an object of this invention to provide a new and improved walk-through gate assembly.

It is another object of this invention to provide a horizontally expandable gate assembly that can be quickly, easily, and securely attached to a pair of opposed vertical surfaces that may be spaced apart by a variable distance, wherein the gate assembly can be easily removable therefrom.

It is also an object of this invention to provide a gate assembly which when installed, can be pivoted in and out of an operational position, and optionally, this pivoting movement can be restricted to movement in only one direction.

It is further an object of this invention to provide a gate assembly with a latch mechanism which can be easily operated by an adult, but cannot be easily operated by an infant or pet.

It is still further an object of this invention to provide a gate assembly with the above advantages which is aesthetically pleasing, as well as easily manufactured and assembled.

It is a further object of this invention to provide a gate assembly that can be extended to span a wide opening, that is constructed and arranged so that gate extension is relatively frictionless, and that is constructed and arranged so that when so extended to span the wide opening, little or no sagging of the expanded gate assembly is experienced.

A more specific object of the invention is to provide a horizontally extendable gate assembly for placement between two spaced apart and vertically extending wall surfaces that define an opening that is to be closed by extension of the gate assembly, the gate assembly comprising a first and a second gate section with each of the gate sections having a horizontal width, a first planar inner face for the first gate section having a first end and a horizontally spaced second end, a second planar inner face for the second gate section having a corresponding first end and horizontally spaced second end, mounting means associated with the first and second gate sections to slidably hold the first and second inner faces adjacent to each other for relative horizontal movement as the gate assembly is horizontally extended to close the opening, the first end of the first gate section defining a first wall boundary of the extended gate assembly and the second end of the second gate section defining a second wall boundary of the extended gate assembly, portions of the first and second inner faces that contain the second end of the first gate section and the first end of the second gate section overlapping by an amount that is determined by an amount of extension of the gate assembly that is required to close the opening, a first horizontal linear slot in the first inner face that extends generally between the first and second ends of the first gate section, a second horizontal linear slot in the second inner face that extends generally between the first and second ends of the second gate section, the first and second linear slots being in a horizontally aligned relationship, first low friction slide block mounted at a fixed position within the first linear slot at a location that is generally adjacent to the second end of the first gate section, the first low friction slide block extending from the first linear slot and being slidably received by the second linear slot, second low friction slide block mounted at a fixed position within the second linear slot at a location that is generally adjacent to the first end of the second gate section, the second low friction slide block extending from the second linear slot and being slidably received by said the first linear slot, and extension stop means associated with the first and second gate sections to limit extension of the gate assembly to prevent the first and second low friction slide blocks from physically engaging when the gate assembly is fully extended.

As a feature of the invention, a first wall mounting means is associated with the first edge of the first gate section, and a second wall mounting means is associated with the second edge of the second gate section.

As an additional feature of the invention, a manually operable gate hinge is releasably associated with the first end of the first gate section, and a manually operable gate latch is releasably associated with the second end of the second gate section.

As another feature of the invention, the first and second linear slots are formed in first and second rigid gate section support bars, and the facing surfaces of these support bars are coated with a low friction coating, to thereby facilitate ease of manual extension of the gate assembly.

Additional objects, advantages and novel features of this invention are set forth in the detailed description that follows. Other objects and advantages will become apparent to those skilled in the art upon examining this detailed description, and will also be learned by the practice of this invention. The objects and advantages of this invention may be realized and attained by means of the instrumentalities, combinations, and methods particularly pointed out in the appended claims.

BRIEF DESCRIPTION OF THE DRAWINGS

The accompanying drawings, which are incorporated in and form a part of the specification, illustrate preferred embodiments of the invention, and together with the detailed description serve to explain the principles of the invention.

DESCRIPTION OF THE PREFERRED EMBODIMENT

Figure 1:
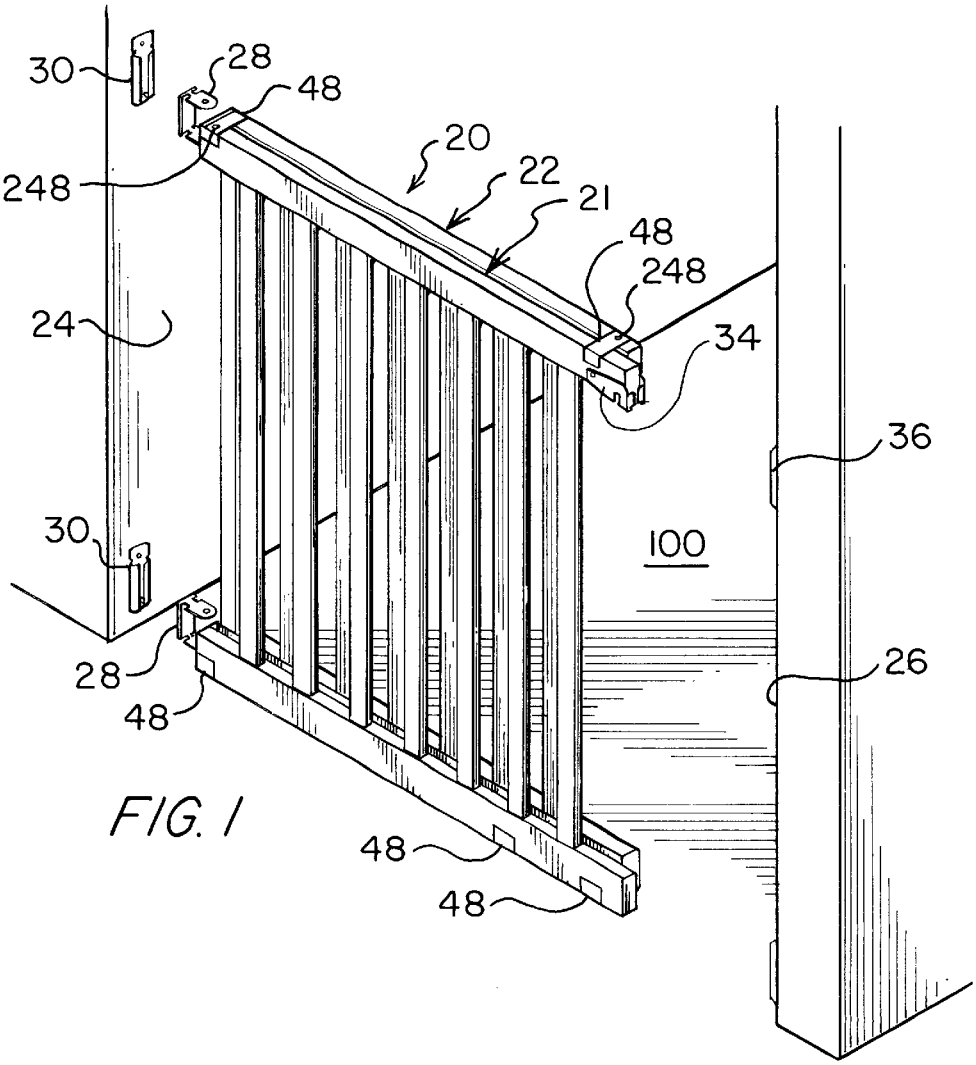
FIG. 1 is a perspective view of a walk-through gate assembly of the present invention, this figure showing two sliding gate sections in a retracted position and disconnected from mounting hardware that is provided on two horizontally spaced and vertically extending walls.
Figure 2:
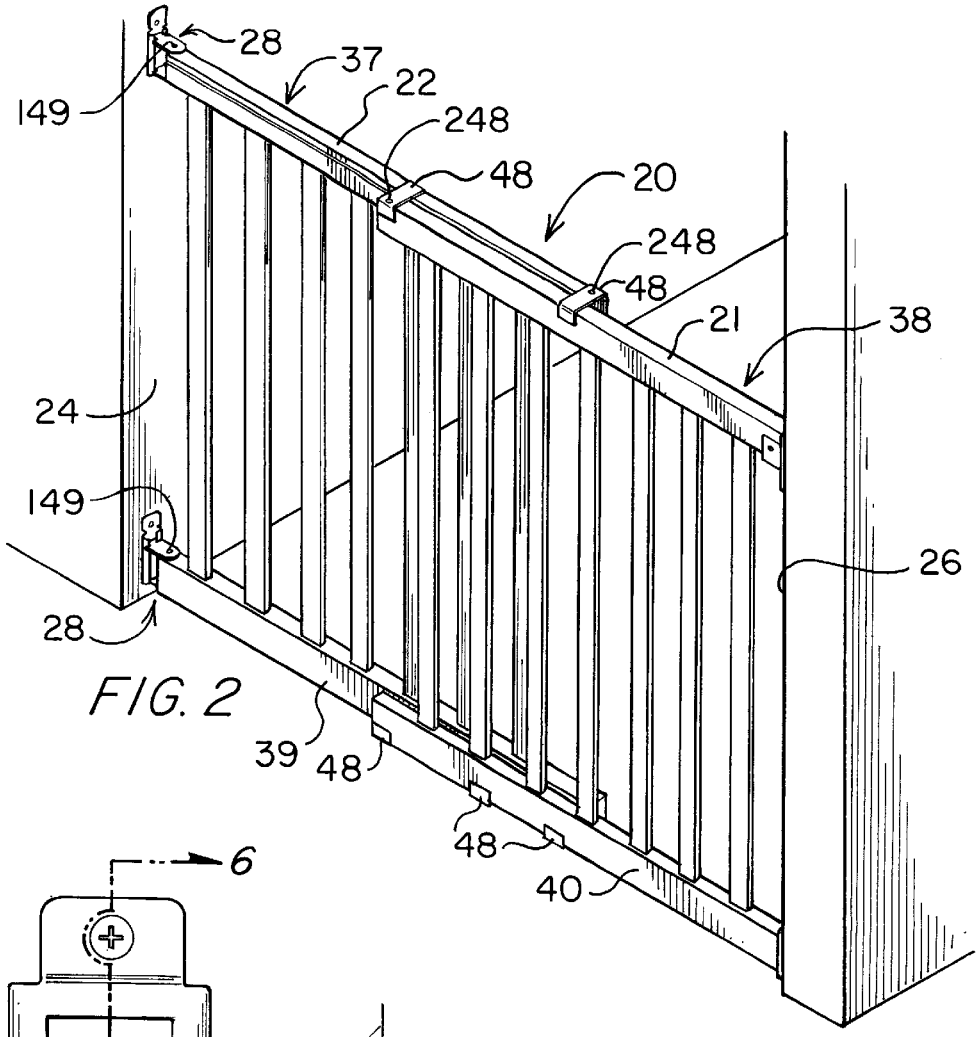
FIG. 2 is a perspective view similar to FIG. 1 showing the sliding gate assembly in an extended position and mounted in the mounting hardware that is provided on the two walls.

With reference to FIGS. 1 and 2, a walk-through gate assembly 20 in accordance with this invention, includes two mating, horizontally slidable, and planar gate sections 21 and 22 that are constructed and arranged to receive latch and hinge hardware that cooperates with latch and hinge hardware that is provided on a pair of horizontally spaced and parallel surfaces or walls 24 and 26 that extend vertically upward from a generally horizontal floor, stairway well, or the like 100. Without limitation thereto, in FIGS. 1 and 2 the left side or end of gate assembly 20 is the hinged side, whereas the right side or end is the latched side.

Slidable gate section 22 includes two vertically spaced and identical metal hinges 28 that are pivotally mounted to gate assembly 20 by way of two horizontally aligned metal pins 149. Note that pins 149 are not shown in FIG. 1. Pins 149 jointly define a vertically extending hinge axis for the left side of gate assembly 20. Upper and lower metal hinges 28 are constructed and arranged to be slidably received by the upper end of two identical upper and lower hinge metal hinge retaining brackets 30 that are mounted at two vertically spaced positions on wall 24.

Figure 3:
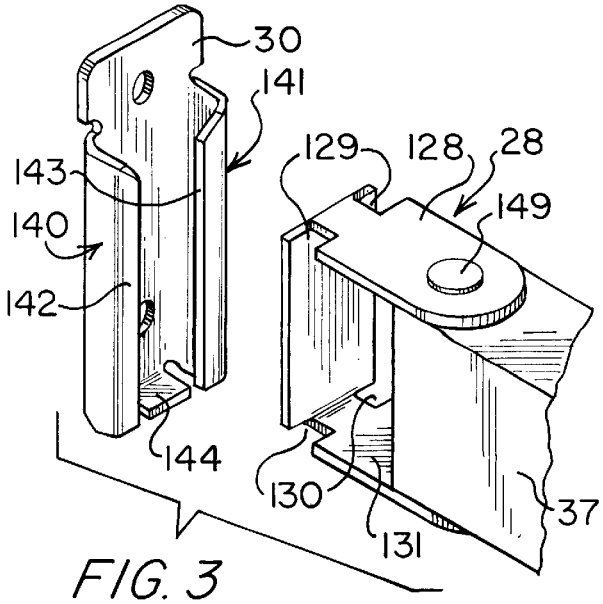
FIG. 3 is an enlarged and fragmentary perspective view of the hinge portion of the walk-through gate assembly of FIG. 1, showing a hinge on a gate section, and showing a wall mount hinge retaining bracket in close proximity thereto.

One of the two hinge/retaining bracket pairs 28, 30 is shown in detail in FIG. 3. Hinge 28 is generally identical in shape and function to the hinge that is disclosed in above-referenced application Ser. No. 08/735,972, an exception being that the upper horizontal arm 128 of FIG. 3 hinge 28 includes two through slots 129 that are vertically aligned with the two through slots 130 that are found in lower horizontal hinge arm 131. Wall-mounted hinge bracket 30 is formed of metal and is provided with two generally parallel and vertically extending U-shaped members 140, 141 having inwardly projecting ridges 142, 143 that are relatively loosely received by the corresponding two through slot pairs 129, 130 within hinge 28. When hinge 28 is mounted within hinge bracket 30, a horizontally extending stop member 144 operates to physically engage the lower side of hinge arm 131, thus stopping vertically downward movement of hinge 28 within hinge bracket 30, and thus producing the operative position shown in FIG. 2. If desired, a manually operable latch may be provided to lock hinge 28 in its operative position within hinge bracket 30, as is shown in above-referenced application Ser. No. 08/735,972.

Figure 8:
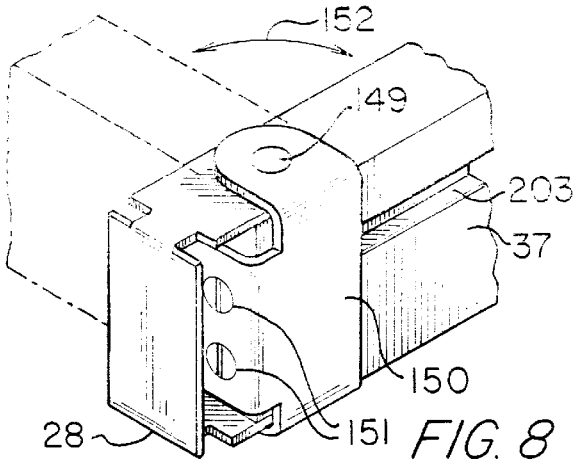
FIG. 8 shows an optional feature of the present invention, wherein a swing stop is associated with the hinge portion of the walk-through gate assembly shown in FIG. 1.

FIG. 8 shows an optional feature of the invention, wherein a metal swing stop 150 has been secured to the left end or side of gate assembly 20, as by the use of two wood screws 151. As has been described above, hinge bracket 28 is secured to wall 26 by way of a bracket 30. As viewed from above, swing stop 150 operates to restrict the opening or swinging of gate assembly 20 to counterclockwise pivoting about pin 149, as is represented by arrow 152 of FIG. 8. Swing stop 150 also pivots with gate assembly 20. However, for ease of viewing, the pivoted position of swing stop 150 has not been shown in FIG. 8. As will be appreciated, swing stop 150 need be associated with only one of the two hinge/hinge bracket pairs 28/30. One utility of swing stop 150 can be appreciated with reference to FIG. 1. If it is assumed that FIG. 1 reference numeral 100 designates the location of a descending flight of stairs, then swing stop 150 can be associated with gate section 22 so as to allow gate assembly to pivot only in a clockwise direction, as viewed from above.

Figure 4:
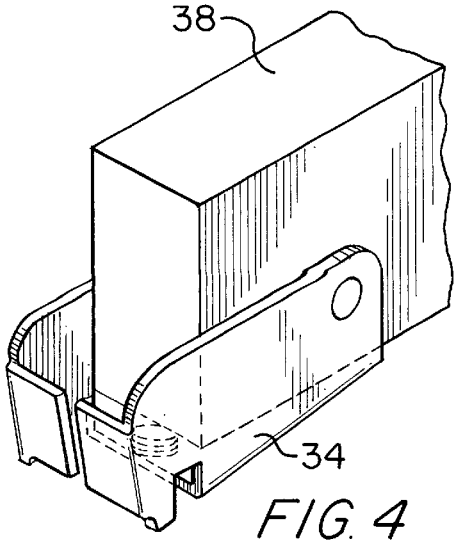
FIG. 4 is an enlarged and fragmentary perspective view of the vertically pivotable latch of the walk-though gate assembly of FIG. 1.
Figure 5:
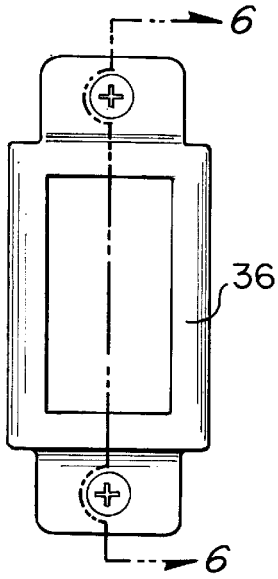
FIG. 5 is an enlarged front view of the latch receptacle that is located or mounted on the wall that faces the latch shown in FIG. 4.
Figure 6:
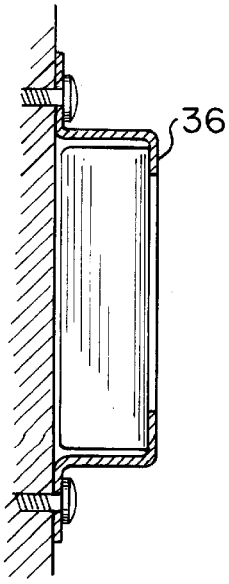
FIG. 6 is a cross-sectional view taken along line 6—6 of FIG. 5, this figure showing how the latch receptacle defines a cavity into which the upper horizontal support bar of a gate section is retained in the latch receptacle when the gate assembly is latched.
Figure 7:
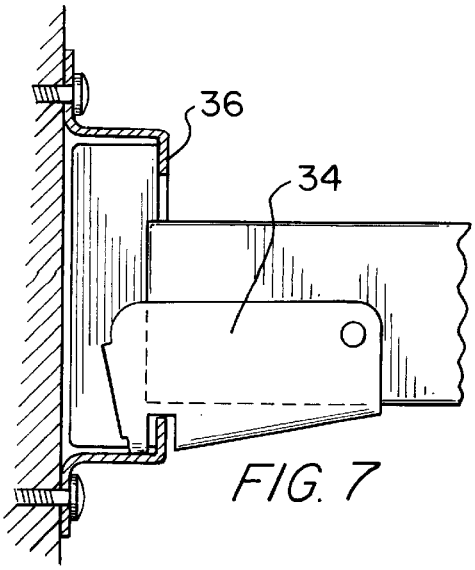
FIG. 7 is a cut away side view showing the FIG. 4 latch engaged with the FIG. 5 latch receptacle.

The second slidable gate section 21 includes a manually operable and metal latch 34 that is located on the right side or end of gate assembly 20. Latch 34 is selectively engageable with a metal latch receptacle 36 that is mounted on wall 26. Latch 34 is best seen in FIG. 4, latch receptacle 36 is best seen in FIGS. 5 and 6, and FIG. 7 shows latch 34 in a latched position within latch receptacle 36. The latch/receptacle pair 34/36 is constructed and arranged as described in above-referenced application Ser. No. 08/735,972.

While a preferred hinge means 28/30 and latch means 34/36 have been described, the spirit and scope of the present invention is not to be limited thereto. That is, the present invention finds utility when any suitable wall mounting means is used at the two opposite ends of gate assembly 20.

The two gate sections 21, 22 are preferably formed of a number of structurally associated linear wood members, and more preferably a hard wood. As perhaps best seen in FIG. 9, each of the two gate sections 21/22, respectively, include an upper and horizontally extending support bar 37/38, as well as a lower and horizontally extending, support bar 39/40. All four support bars 37–40 are of a generally rectangular and vertical cross section; for example, about 1.500-inch in a vertical direction and about 0.750-inch in a horizontal direction. Support bars 37 and 38 are mutually parallel and occupy a common horizontal plane, and support bars 39 and 40 are mutually parallel and occupy a common horizontal plane.

A plurality of vertical and parallel slats or spindles 46 within each of the two gate sections 21/22 operate to interconnecting the upper and lower support bars of each gate section. For example, each gate section is provided with 10 spindles that are evenly spaced, with a spindle-space being left at the ends of the gate sections that overlap. More generally, the upper and lower support bars of each of the two gate sections 21/22 are joined by spindles 46 to form two closure panel means.

Without limitation thereto, in an embodiment of the invention, the two gate sections 21/22 each comprise a vertically planar gate section, and each gate section had generally the same rectangular dimension. For example, each gate section had a vertical height dimension (measured perpendicular to support rods 37/38) of about 28.5-inches, had a horizontal width dimension of about 36.25-inches, and the assembled gate assembly 20 had a horizontal thickness dimension of about 1.5-inches. In the fully retracted state, the horizontal width of an assembled gate assemble 20 in accordance with this embodiment of the invention, was about 39.0-inches, whereas its fully extended width was about 64.0-inches.

As described in above-referenced application Ser. No. 08/735,972, and as perhaps best seen in FIGS. 1 and 2, five identical U-shaped metal brackets 48 are associated with the two gate sections 21/22 in order to link, mount, or retain the two gate sections in a closely adjacent or planar facing position. As so mounted, gate sections 21/22 are supported in a manner to allow relative longitudinal or horizontal movement of the two gate sections 21/22, as slidable gate assembly 20 is manually closed or retracted for storage or the like (as shown in FIG. 1), or as gate assembly 20 is relatively fully extended for attachment to walls 24/26, as shown in FIG. 2.

With reference to FIG. 2, it can be seen that the upper two of the metal brackets 48 are attached to opposite ones of the two upper support bars 37/38, as by the use of wood screws 248. For example, in FIG. 2, the left most one of the two upper brackets 48 is attached to, and moves with, upper support bar 38, whereas the right most one of the two upper brackets 48 is attached to and moves with upper support bar 37. In a similar manner, the right most and left most ones of the three lower brackets 48 are mounted on selected ones of the two lower support bars 39 and 40 so as to move therewith.

As described in above-referenced application Ser. No. 08/735,972, and as perhaps best seen in FIG. 9, the intermediate one of the three lower brackets 48 and the right most one of the three lower brackets 48 are mounted on opposite ones of the two lower support bars 39/40. In this way, these two lower brackets 48 operate as a stop means that operates to limit the extent of relative horizontal movement of the two gate sections 21/22.

Figure 9:
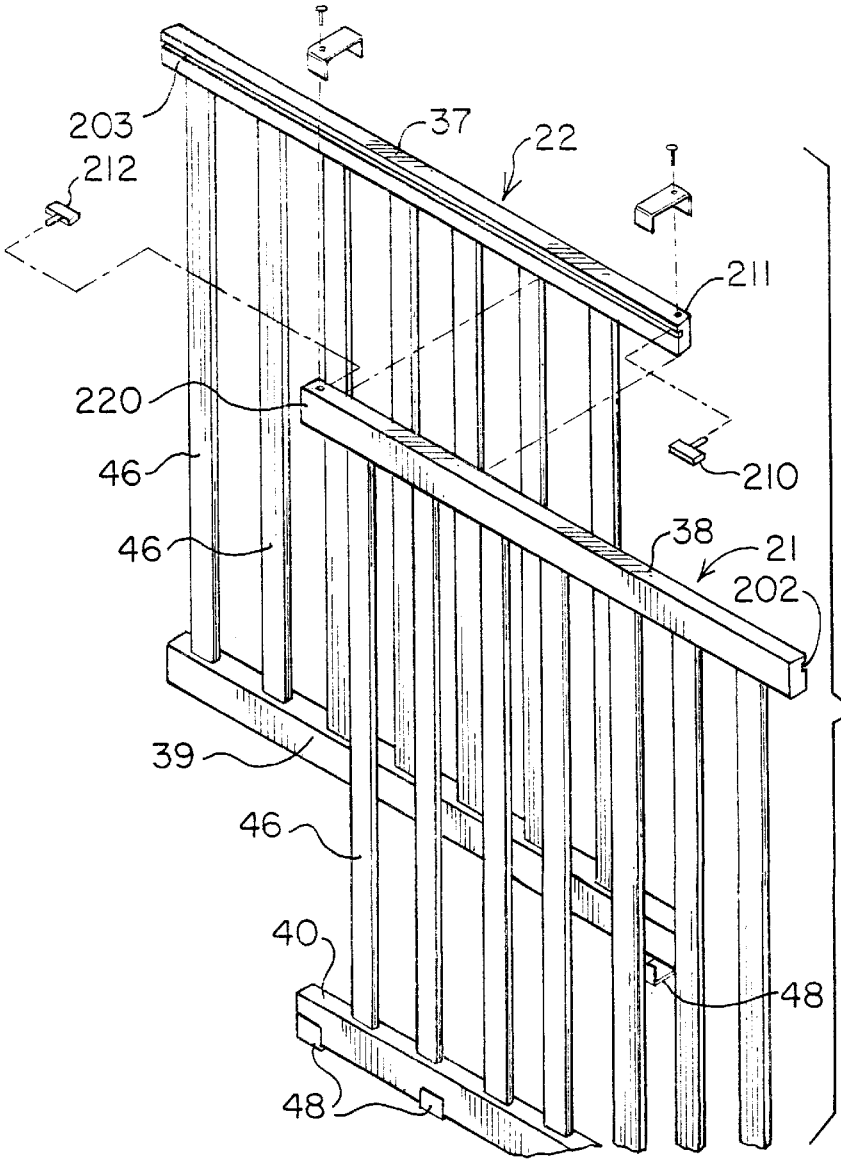
FIG. 9 is an exploded view of the two gate sections, this view showing the shape of the pair of mating linear slots that are formed in the upper support bars of the two gate sections, this view showing a first low friction slide block that is pin mounted at a fixed position in one end of a first linear slot, so as to be slidably received within the second linear slot, and this view also showing a second low friction slide block that is pin mounted at a fixed position in the opposite end of the second linear slot, so as to be slidably received within the first linear slot.

For example, in FIGS. 2 and 9, the intermediate bracket 48 and the left most bracket 48 are mounted on and move with gate section 21, whereas the right most lower bracket 48 is mounted on and moves with gate section 22. Since the FIG. 2 gate assembly 20 is not fully extended, the right most and the intermediate lower bracket 48 remain horizontally spaced. However, when gate assembly 20 is fully extended, mechanical interference between these two lower brackets 48 operates to limit further horizontal extension of gate assembly 20. Without limitation thereto, in FIGS. 2 and 9, the right most bracket 48 is mounted generally coincident with the right end of lower support bar 39, the left most bracket 48 is mounted generally coincident with the left end of lower support bar 40, and intermediate bracket 48 is mounted on lower support bar 40 spaced about 9.0-inches from the left-most bracket 48.

As described in above-referenced application Ser. No. 08/735,972, in order to reduce sliding friction between brackets 48 and upper and lower support bars 39/40 during horizontal sliding of gate sections 21/22, a plastic insert layer is provided on each surface of a bracket 48 that faces a moving gate section. Preferably, the plastic insert layer is composed of nylon. In addition, each U-shaped bracket 48 also includes a pair of ridges in the top surface thereof, to thereby increase the strength and the rigidity of metal brackets 48.

Figure 11:
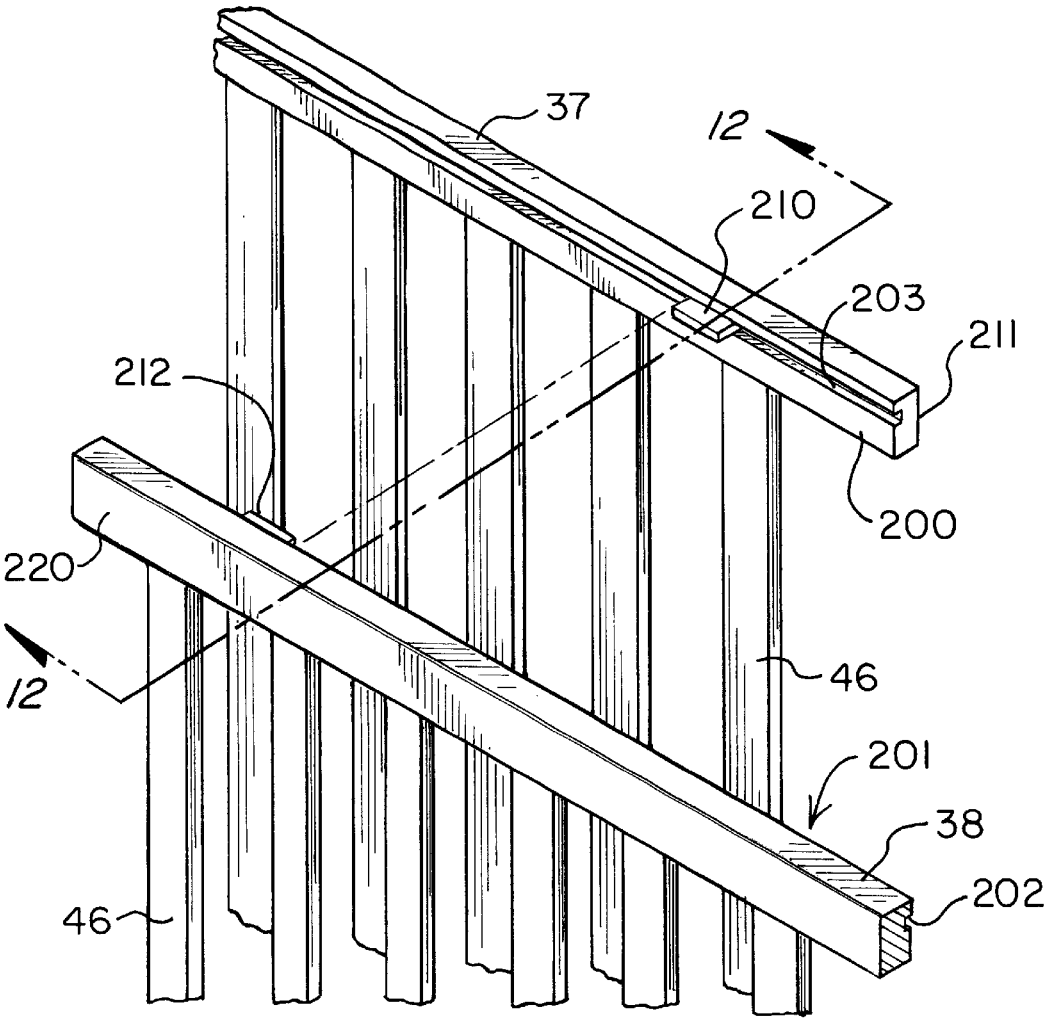
FIG. 11 shows an optional feature of the present invention, wherein the two low friction slide blocks of FIG. 9 are mounted at fixed positions within their respective linear slots, but spaced from the two slot ends so that mechanical interference of the two slide blocks will function as an alternative extension stop that operates to limit the horizontal extension of the gate assembly of FIG. 1.
Figure 12:
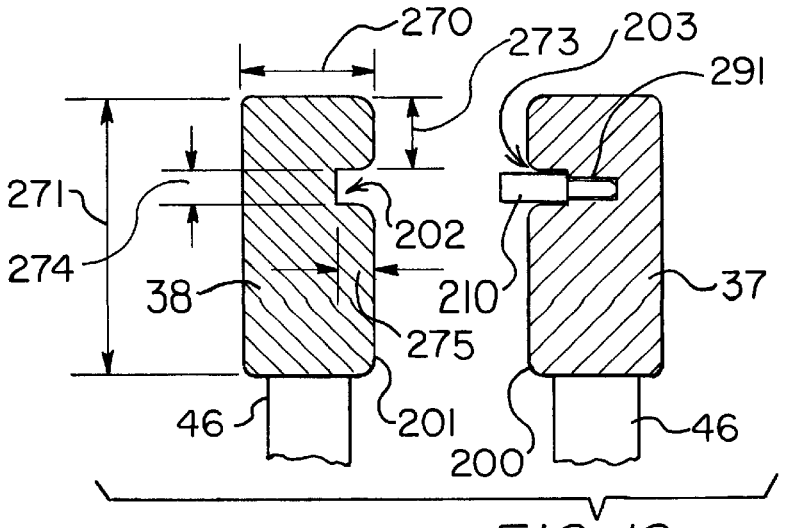
FIG. 12 is a cross-section view of the two upper support bars of FIG. 11, wherein a low friction slide block is shown only in one of the two upper support bars, and wherein a pin that is mounted to the slide block is shown in full line.

With particular reference to FIGS. 9, 11 and 12, an important aspect of the present invention involves the construction and arrangement of the two physically abutting and slotted inner slide faces 200/201 that are provided by the two upper support bars 37 and 38.

More specifically, a new and unusual construction and arrangement of this invention comprises, (1) a first horizontally extending linear slot 202 that is provided in a first inner face 201 that extends generally between the two horizontal ends of gate section 21, (2) a second and similar horizontally extending linear slot 203 that is provided in a second inner face 200 that extends generally between the two horizontal ends of gate section 22, (3) wherein first and second linear slots 202/203 are in a horizontally aligned relationship, (4) with a low friction slide block 210 mounted at a fixed position within linear slot 203 at a location that is generally adjacent to the overlap end 211 of support bar 37 and gate section 22, (5) wherein a second and similar low friction slide block 212 is mounted at a fixed position within linear slot 202 at a location that is generally adjacent to the overlap end 220 of support bar 38 and gate section 21, and (6) wherein slide blocks 210/212 extend from their fixed positions within their respective linear slots 203/202 to be slidably received by the other one of the linear slots 202/203.

In one embodiment of the invention, an extension stop means that is associated with gate sections 21/22 (i.e., the extension stop means provided by mechanical interference between the lower right most bracket 48 and the lower intermediate bracket 48) operates to limit the horizontal extension of gate assembly 20, to prevent low friction slide blocks 210/212 from physically engaging when gate assembly 20 is fully extended. In another embodiment of the invention, the lower intermediate bracket 48 is eliminated, and the two slide blocks 210/212 are positioned inward from the ends 211/220 of their respective linear slots 203/202, as is shown in FIG. 1. In this FIG. 11 embodiment, the two slide blocks 210/212 not only prevent sagging of an extended gate assembly 20, but also physically engage to limit the horizontal extension of gate assembly 20.

As a feature of the invention, support bars 37/38 are formed of a high quality wood and the facing surfaces 200/201 of support bars 37/38 are provided with a low friction coating, to thereby facilitate the ease of manual extension of gate assembly 20. An example is to lacquer support bars 37/38 and then provide an appropriate wax coating on inner faces 200/210.

Without limitation thereto, and with reference to FIG. 12, in an embodiment of the invention, support bars 37/38 were of generally equal dimensions, and example dimensions for this embodiment of the invention were as follows, dimension 270 was about 0.7500-inch, dimension 271 was about 1.5000-inch, dimension 272 was about 0.4030-inch, dimension 273 was about 0.1870-inch, and dimension 274 was about 0.1936-inch.

Figure 10:
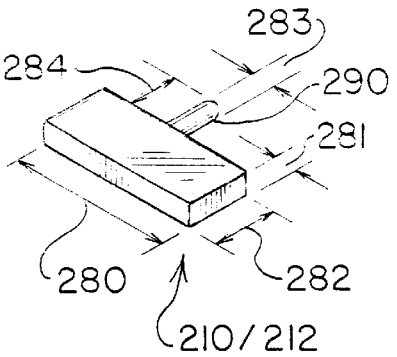
FIG. 10 is a perspective view of one of the two identical low friction slide blocks of FIG. 9

Without limitation thereto, and with reference to FIG. 10, in this embodiment of the invention, slide blocks 210/212 were of generally equal dimensions, both slide blocks were formed of a low friction plastic, for example a hard, rigid, strong, tough and resilient plastic such as an acetal resin, or the polyamide polymer known by the generic name nylon, and both slide blocks included a mounting pin 290 that enabled mounting the slide block within a hole 291 (see FIG. 12) that was provided in each of the slots 202/203.

Example dimensions for the slide blocks 210/212 that functioned with the above-dimensioned support bars 37/38 were as follows, dimension 280 was about 1.000-inch, dimension 281 was about 0.179-inch, dimension 282 was about 0.365-inch, the diameter of pin 290, that is dimension 283 about 0.060-inch, and the axial length of pin 290, that is dimension 284 was about 0.250-inch.

From the above detailed description of preferred embodiments of this invention it can be seen that a horizontally extendable gate assembly 20 is provided for placement between two horizontally spaced apart and vertically extending wall surfaces that 24/26 that define an opening to be closed by horizontal extension of the gate assembly. New and unusual gate assembly 20 comprises a first generally planar gate section 21 having an inner face 201, a second generally planar gate section 22 having an inner face 200, mounting means 48 associated with gate sections 21/22 to slidably hold inner faces 200/201 in a generally abutting relationship while permitting relative horizontal movement of gate sections 21/22 as gate assembly 20 is horizontally extended to close the opening, a first horizontally extending slot 202 within inner face 201, slot 202 having a first slot end that is adjacent to a first wall end of gate assembly 20 and slot 202 having a second slot end 220, a second horizontally extending slot 203 within inner face 200 in horizontal alignment with slot 202, slot 203 having a first slot end 211 that corresponds to the first slot end of slot 202, and slot 203 having a second slot end that both corresponds to the second slot end of slot 202 and is adjacent to a second wall end of gate assembly 20, a first low friction slide 212 mounted at a fixed position within slot 202 at a location that is generally adjacent to the end 220 of gate section 21, low friction slide 212 extending from slot 202 and being slidably received by slot 203, and a second low friction slide 210 mounted at a fixed position within slot 202 at a location that is generally adjacent to the end 211 of gate section 22, low friction slide 210 extending from slot 203 and being slidably received by slot 202.

It is to be understood that the above detailed description of embodiments of this invention will serve to guide those skilled in the related art to yet other embodiments that are clearly within the spirit and scope of this invention. Thus, the above detailed description is not to be taken as a limitation on the spirit and scope of this invention.

What is claimed is:

1. A gate assembly that is manually extendable in the absence of a spring bias force, for placement of the gate assembly between two horizontally spaced apart and vertically extending surfaces that define an opening to be closed by said gate assembly, comprising:

a first generally planar gate section having a first outer face and a first inner face;

a second generally planar gate section having a second outer face and a second inner face;

U-shaped mounting means engaging said first and second outer faces for slidably holding said first and second inner faces in a generally abutting and overlapping relationship, said mounting means being constructed and arranged to facilitate relative horizontal manual movement of said first and second gate sections and to manually vary an amount of said overlap as said gate assembly is horizontally extended to close the opening;

a first horizontally extending U-shaped slot in said first inner face, said first slot having a first slot end adjacent to a first end of said gate assembly, and said first U-shaped slot having a second slot end, said first U-shaped slot having two physically spaced and parallel arms that extend orthogonally from a common center arm;

a second horizontally extending U-shaped slot in said second inner face in horizontal alignment with said first U-shaped slot, said second U-shaped slot having a first slot end corresponding to said first slot end of said first U-shaped slot, said second U-shaped slot having a second slot end corresponding to said second slot end of said first U-shaped slot and adjacent to a second end of said gate assembly, and said second U-shaped slot having two physically spaced and parallel arms that extend orthogonally from a common center arm;

a first low friction slide mounted at a fixed position within said first U-shaped slot at a location that is generally adjacent to said first end of said first gate section, said first low friction slide having a first U-shaped portion extending from said first U-shaped slot and being freely and slidably received by said second U-shaped slot, said first U-shaped portion having two physically spaced and parallel surfaces that extend orthogonally from a common center surface;

a second low friction slide mounted at a fixed position within said second U-shaped slot at a location that is generally adjacent to said second end of said second gate section, said second low friction slide having a second U-shaped portion extending from said second U-shaped slot and being freely and slidably received by said first U-shaped slot, said second U-shaped portion having two physically spaced and parallel surfaces that extend orthogonally from a common center surface;

first gate mounting means on a first end of said gate assembly; and second gate mounting means on a second end of said gate assembly.

2. The gate assembly of claim 1 including:

extension stop means on said first and second gate sections, said extension stop means operating to limit said horizontal extension of said gate assembly to a fully extended position whereat a minimum overlap of said first and second faces occurs.

3. The gate assembly of claim 2 wherein said extension stop means comprises physical engagement of said first and second low friction slides when said gate assembly is fully extended.

4. The gate assembly of claim 3 wherein said first gate mounting means comprises one of the group gate hinge and gate latch, and wherein said second gate mounting means comprises the other of the group gate hinge and gate latch.

5. The gate assembly of claim 4 including:

swing stop means on said gate hinge and operative to limit pivotal opening of said gate assembly to one direction of pivoting.

6. The gate assembly of claim 5 wherein said gate hinge and said gate latch are manually operable.

7. The gate assembly of claim 1 including:

a low friction coating on said first and second inner faces;

manually operable hinge means on said first end of said gate assembly;

swing stop means on said hinge means operative to limit opening of said gate assembly to one direction of pivoting;

manually operable latch means on said second end of said gate assembly; and extension stop means on said first and second gate sections operating to limit horizontal extension of said gate assembly.

8. A gate assembly that is manually extendable in the absence of a spring bias force, for placement of the assembly between two spaced apart vertical surfaces that extend upward from a horizontal surface to thereby define an opening that is to be closed by said gate assembly, comprising:

a first gate section having a vertical height dimension and a horizontal width dimension;

said first gate section having, a first linear upper support bar that extends in a horizontal direction and includes a first end that defines a first end of said gate assembly and a second end, a first outer face on said first linear upper support bar, first inner face on said first linear upper support bar, a first linear lower support bar, and first vertically extending gate panel means coupling said first linear upper support bar to said first linear lower support bar;

a second gate section having a vertical height dimension and a horizontal width dimension;

said second gate section having, a second linear upper support bar that extends in a horizontal direction and includes a first end that corresponds to said first end of said first linear upper support bar, and a second end that corresponds to said second end of said first linear upper support bar and that defines a second end of said gate assembly, a second outer face on said second linear upper support bar, a second inner face on said second linear upper support bar, a second linear lower support bar, and second vertically extending gate panel means coupling said second linear upper support bar to said second linear lower support bar;

U-shaped mounting means engaging said first and second outer faces for slidably holding said first linear upper support bar in a common horizontal plane with said second linear upper support bar and with said first inner face in sliding engagement with and slidably overlapping said second inner face;

said U-shaped mounting means being constructed and arranged to facilitate relative horizontal movement of said first and second gate sections as said gate assembly is horizontally extended to vary an amount of said overlap of said first and second inner faces and to close the opening, said first and second inner faces overlapping by an amount that is determine by an amount of horizontal extension of said gate assembly that is required to close the opening;

a first linear U-shaped slot formed in said first inner face and a second linear U-shaped slot formed in said second inner face, said first and second U-shaped linear slots occupying a common horizontal plane, and said first and second U-shaped linear slots each having physically spaced and parallel arms that extend orthogonally from a common center arm;

a first low friction slide block mounted at a fixed position within said first linear U-shaped slot at a location generally adjacent to said first end of said gate assembly, said first low friction slide block having a first U-shaped portion thereof extending from said first linear slot and being freely and slidably received by said second linear U-shaped slot, and said first U-shaped portion having first and second physically spaced and parallel surfaces that extend orthogonally from a common center surface;

a second low friction slide block mounted at a fixed position within said second U-shaped linear slot at a location that is generally adjacent to said second end of said gate section, said second low friction slide block having a second U-shaped portion thereof extending from said second linear U-shaped slot and being freely and slidably received by said first linear U-shaped slot, and said second U-shaped portion having first and second physically spaced and parallel surfaces that extend orthogonally from a common center surface;

first vertical surface mounting means on said first side of said gate assembly; and second vertical surface mounting means on said second side of said gate assembly.

9. The gate assembly of claim 8 including:

extension stop means on said first and second gate sections, said extension stop means operating to limit extension of said gate assembly so as to prevent said first and second low friction slide blocks from physically engaging when said gate assembly is fully extended to a position whereat a minimum overlap of said first and second inner faces occurs.

10. The gate assembly of claim 9 wherein said first vertical surface mounting means comprises one of the group gate hinge and gate latch, and wherein said second vertical surface mounting means comprises the other of the group gate hinge and gate latch.

11. The gate assembly of claim 10 wherein said gate hinge includes a swing stop operating to restrict opening of said gate assembly to one direction of horizontal pivoting.

12. The gate assembly of claim 8 wherein said first and second inner faces include a low friction coating.

13. The gate assembly of claim 8 including:

a low friction coating on said first and second inner faces;

extension stop means on said first and second gate sections to limit extension of said gate assembly to a fully extended position whereat a minimum overlap of said first and second inner faces occurs;

hinge means on said first side of said gate assembly;

swing stop means on said hinge means operating to restrict opening of said gate assembly; and latch means on said second side of said gate assembly.

14. A gate assembly that is manually extendable in the absence of a spring bias force, for placement of the extended gate assembly between two spaced apart and vertically extending wall surfaces that define an opening that is to be closed by the extended gate assembly, comprising:

a first and a second gate section, each of said gate sections having a horizontal width;

a first outer face for said first gate section;

a first inner face for the first gate section, said first inner face having a first vertical edge and a horizontally spaced second vertical edge;

a second outer face for said second gate section;

a second inner face for the second gate section, said second inner face having a first vertical edge and a horizontally spaced second vertical edge;

U-shaped mounting means physically engaging said first and second outer faces for slidably holding said first and second inner faces adjacent to each other for relative horizontal movement as the gate assembly is horizontally extended to close the opening;

said first vertical edge of said first gate section defining a first wall boundary of the extended gate assembly, said second vertical edge of said second gate section defining a second wall boundary of the extended gate assembly, and portions of said first and second inner faces that contain said second vertical edge of said first gate section and said first vertical edge of said second gate section overlapping by an amount that is determined by an amount of extension of the gate assembly required to close the opening;

a first horizontally extending and generally U-shaped linear slot in said first inner face extending generally between said first and second vertical edges of said first gate section, said first U-shaped slot having a first linear opening, and said first linear opening having physically spaced and parallel arms that extend orthogonally from a common center arm;

a second horizontally extending and generally U-shaped linear slot in said second inner face extending generally between said first and second vertical edges of said second gate section, said second U-shaped slot having a second linear opening, and said second linear opening having physically spaced and parallel arms that extend orthogonally from a common center arm;

said first and second U-shaped linear slots occupying a common horizontal plane, and said first and second linear openings being in horizontal alignment and facing each other;

first slide means mounted at a fixed position within said first U-shaped linear slot at a location generally adjacent to said first vertical edge of said first gate section, said first slide means having a first U-shaped portion extending from said first linear opening and being freely and slidably received by said second linear opening, and said first U-shaped shaped portion having first and second physically spaced and parallel surfaces that extend orthogonally from a common center surface;

second slide means mounted at a fixed position within said second U-shaped linear slot at a location generally adjacent to said second vertical edge of said second gate section, said second slide means having a second U-shaped portion extending from said second linear opening and being freely and slidably received by said first linear opening, and said second U-shaped portion having first and second physically spaced and parallel surfaces that extend orthogonally from a common center surface;

extension stop means on said first and second gate sections, said extension stop means operating to limit extension of said gate assembly to prevent said first and second slide means from physically engaging when the gate assembly is fully extended;

first wall surface mounting means on said first vertical edge of said first gate section; and second wall surface mounting means on said second vertical edge of said second gate section.

15. The gate assembly of claim 14 wherein said first wall surface mounting means is one of the group manually operable gate hinge and manually operable gate latch, and said second wall surface mounting means is the other of said group manually operable gate hinge and manually operable gate latch.

16. The gate assembly of claim 15 including:

swing stop means on said manually operable gate hinge, said swing means providing for one direction of opening for the gate assembly.

17. The gate assembly of claim 14:

wherein said first and second slide means are formed of a low friction rigid material;

wherein first inner face of said first gate section and said second inner face of said second gate section respectively include first and second horizontally extending gate section support bars;

wherein said first and second rigid gate section support bars respectively include a first and a second facing surface;

wherein said first and second facing surfaces respectively include said first and second U-shaped slots; and wherein at least one of said first and second facing surfaces includes a low friction coating.

* * * * *